United States Patent [19]

Dion

[11] Patent Number: 4,907,730

[45] Date of Patent: Mar. 13, 1990

[54] PNEUMATIC NAILER

[75] Inventor: Jean-Paul Dion, Québec, Canada

[73] Assignee: Laboratoire Primatech Inc., Quebec, Canada

[21] Appl. No.: 330,374

[22] Filed: Mar. 29, 1989

[51] Int. Cl.[4] ..... B25C 1/04

[52] U.S. Cl. ..... 227/8; 227/148; 227/156; 227/130

[58] Field of Search ..... 227/8, 120, 128, 148, 227/156, 130

[56] References Cited

U.S. PATENT DOCUMENTS 3,360,176 12/1967 Gehl et al. ..... 227/156 X 3,542,273 11/1970 Hedrick ..... 227/148 X

*Primary Examiner*—Paul A. Bell

*Attorney, Agent, or Firm*—Pierre Lespérance

[57] ABSTRACT

There is disclosed a pneumatic nailing tool operated by a hammer blow or the like substantial force. The tool also carries a feeler which ensures operation of the tool only when the latter is properly positioned on the work-piece to be nailed. The above characteristics constitute two safety features preventing accidental operation of the nailing tool. The tool also ejects the nail with a delay after the hammer blow, whereby part of the force of the hammer blow serves to push the work-piece in proper position before being nailed.

8 Claims, 3 Drawing Sheets

PNEUMATIC NAILER

FIELD OF THE INVENTION

The present invention relates to a pneumatic nailing tool and, more particularly, to such a tool for nailing tongue-and-groove floor planks.

BACKGROUND OF THE INVENTION

It is known to provide pneumatically-operated nailing tools in which the nailing stroke is initiated by manually pulling a trigger. Such tools are dangerous to use, since the trigger can be easily accidentally pulled and a nail ejected in any direction. Nailing tools are used inter alia by workmen installing hardwood flooring. Such flooring consists of tongue-and-groove narrow planks which must be individually fitted close to one another and then nailed in position. Such workmen require a hammer for their work.

OBJECTS OF THE INVENTION

It is therefore an object of the present invention to provide a pneumatically-operated nailing tool which requires a hammer blow or the like force for nail ejection, thereby constituting a major safety feature.

Another object of the present invention resides in a nailing tool of the character described, which further requires that the tool be properly positioned on the work-piece to be nailed, in order that the nail ejection be accomplished.

Another object of the present invention resides in the provision of a nailing tool of the character described, especially designed for nailing tongue-and-groove planks at 45 degrees to the plank at the root of the tongue.

Another object of the present invention is to provide a nailing tool of the character described, which operates with a certain delay sufficient for the initial force of the hammer blow to push the plank to be nailed in proper position against a contiguous already-nailed plank before nail ejection takes place.

Another object of the present invention resides in the provision of a nailing tool of the character described, which is made with a minimum of components, the latter being long-lasting and their relative displacement acting as valve means.

SUMMARY OF THE INVENTION

In accordance with the teachings of the invention, there is disclosed a nailing tool comprising a body defining a reservoir adapted to be fed with compressed air, a cylinder fixed within said body and having a lower and an upper end, a plug closing the lower end of said cylinder and having a nailing plunger-receiving slit, a piston slidable in said cylinder, a nailing plunger fixed to said piston and extending through said slit, said piston reciprocable in said cylinder to cause said plunger to accomplish a nailing stroke, said cylinder fully open at its upper end, said body defining a chamber co-axial with and communicating with said cylinder upper end and with said reservoir, a cylinder closure having a leak-proof sliding fit with said chamber and reciprocable therein between a down-position resting on and closing said cylinder upper end, and an up-position opening said cylinder upper end; said closure having an underface which, when said closure is in down-position, protrudes outwardly from said cylinder and is exposed to the compressed air in said reservoir, a trigger located over said closure and movable between a top limit position and a down limit position in said chamber and having a head exposed externally of said body, a compression spring located between said trigger and said closure within said chamber, a first air-feeding passage communicating said reservoir and said chamber above said closure, said trigger closing and opening said first air passage in its down and top limit positions, respectively, a first air exhaust passage communicating said chamber above said closure with the ambient air, a second air exhaust passage extending through said closure and communicating the space of said cylinder above said piston with the ambient air, said trigger closing and opening said first air exhaust passage to ambient air in its top and down limit positions, respectively, said second exhaust air passage being closed and open to ambient air in the up-and-down positions of said closure, respectively, said trigger being in top position, the sum of the downward forces exerted by said compression spring and by said compressed air onto said closure when closed being greater than the upward force exerted by said compressed air on said closure when closed, the downward force exerted by said compression spring on said closure when closed being smaller than the upward force exerted by said compressed air on said closure when closed, whereby in the rest-position of said tool, the air pressure in said chamber above said closure is equal to the air pressure in said reservoir, the air pressure in said cylinder above said piston is ambient air, said closure being kept closed not only by said compression spring but also by the force differential exerted by said air pressure over and under said closure, and a downward impact force exerted on said trigger causes downward movement of said trigger against the bias of said compression spring and exhaust of the compressed air in said chamber above said closure through said first exhaust means, whereby said closure moves to its up-position closing said second air exhaust passage and allowing compressed air from said reservoir to enter said cylinder and cause said piston to effect a nailing stroke.

Preferably, there is provided a second air-feeding passage communicating said reservoir and said chamber above said closure, a normally-open valve means in said second air-feeding passage and a feeler means carried by said tool and connected to said valve means to close the same when said feeler means makes contact with and senses that the tool is properly positioned on a work-piece to be nailed, the air flow from said reservoir through said second air exhaust passage when open, preventing the air pressure in said chamber above said closure from dropping sufficiently to cause opening of said closure.

Advantageously, said body has a base face adapted to contact said work-piece and said valve means includes a needle valve member extending through said reservoir and having a pointed end entering an inlet of said second air-feeding passage, a spring urging said needle valve to open position, said feeler means including a disc eccentrically pivoted to said body adjacent said base face, a connection between said disc and said needle valve, said last-named spring biasing said disc to a position with a portion thereof protruding from said base face, so that said needle valve closes said inlet upon said feeler disc contacting and being retracted by a work-piece.

It is envisioned that said trigger includes a skirt in slidable sealing engagement with said chamber above said closure, said skirt having a greater diameter than the head of said trigger, said chamber having a restricted portion against which said skirt abuts in the top limit position of said trigger, said first air-feeding passage opening within said chamber above said closure at a position below said skirt when said trigger in its top limit position, and opposite said skirt when said trigger is in its lower limit position, whereby said skirt closes said first air-feeding passage in the latter position.

Preferably, said closure has a central upwardlyextending stem, said stem having an upper end portion in leakproof slidable engagement with a central bore of said trigger above said skirt, said second air exhaust passage extending through the centre of said closure, through said stem and through a lateral bore in the head of said trigger to communicate with the exterior of said body, relative movement between said trigger and said stem causing opening and closing of said second air exhaust passage at said lateral bore.

It is desirable that an air storage chamber be provided to be in communication with said cylinder adjacent said plug, the air in said cylinder being ahead of said piston being transferred and compressed within said storage chamber during the nailing stroke of said piston and returning said piston at the end of said nailing stroke to an initial position adjacent said closure.

Advantageously, a restricted bleeding passage is provided within said piston establishing a communication between the two portions of said cylinder located on opposite sides of said piston, whereby compressed air pushing said piston during its nailing stroke is partly transferred through said bleeding passage ahead of said piston and into said storage chamber.

Preferably, said storage chamber forms an annular chamber surrounding said cylinder within said body.

BRIEF DESCRIPTION OF THE DRAWINGS

In the drawings, like reference characters indicate like elements throughout.

DETAILED DESCRIPTION OF THE PREFERRED EMBODIMENT

Figure 1:
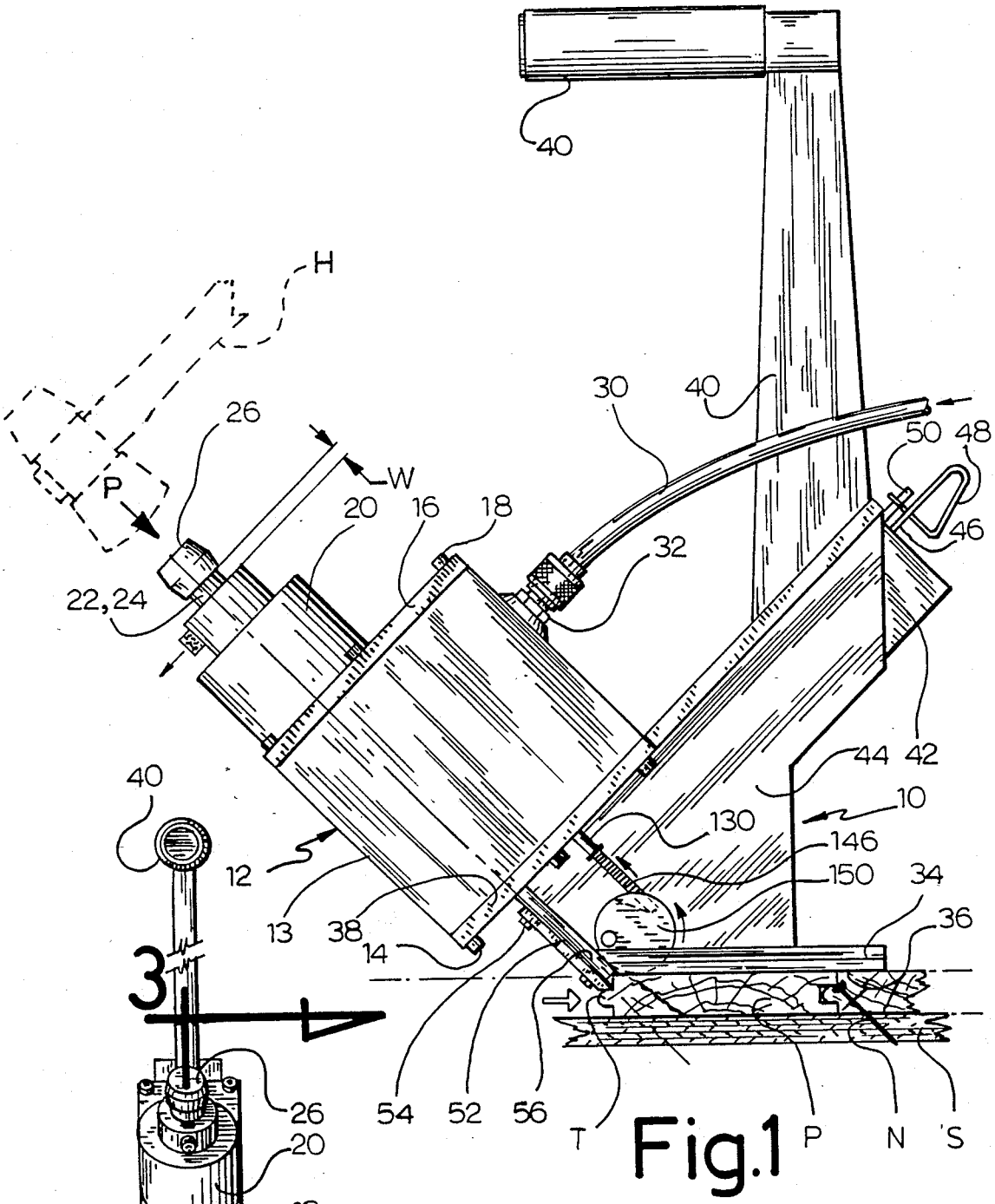
FIG. 1 is a side elevation of the nailing tool of the invention in position on a flooring plank ready to nail the same.
Figure 2:
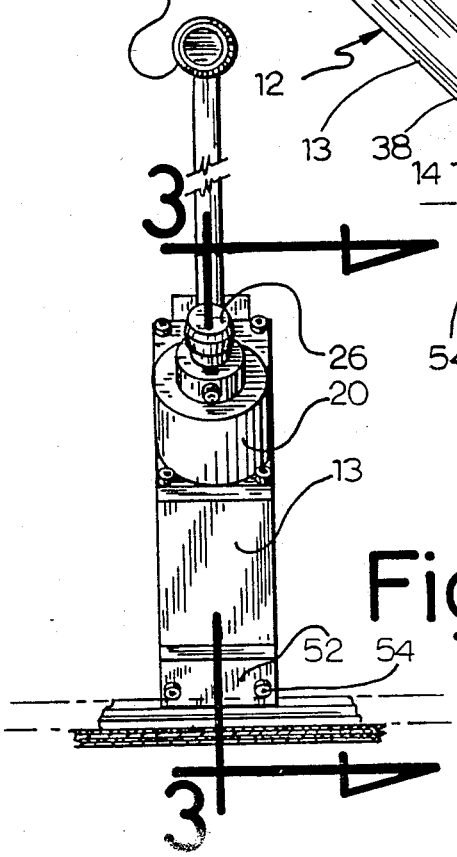
FIG. 2 is a front end elevation of the nailing tool.

The tool body comprises a base 10 to which is secured a casing 12 by means of bolts 14, the top open end of the casing 12 being closed by a cover plate 16 by bolts 18. The cover plate 16 forms an extension 20 from which protrudes the head 22 of a trigger 24, the head 22 being covered by an impact-resisting cap 26, for instance made of polyurethane. The trigger head 22 is adapted to be stricken by a hammer H, so as to operate the tool: an important force must, therefore, be imparted to the trigger 24.

The casing 12, its cover plate 16 and base 10 form a body, within the interior of which is defined an air reservoir 28 adapted to be filled with compressed air through an air hose 30 removably connected to the body coupling 32 and adapted to be connected to a compressed air source.

The base 10 has a work-piece contacting plate 34, the underface 36 of which is adapted to contact the workpiece to be nailed, such as hardwood flooring planks P of the tongue-and-groove type. Such flooring planks are nailed to an underlying support S, such as plywood panels, by nails N driven at the root of the tongue and at substantially 45-degree angle to the top face of the plank P. Therefore, for such a purpose, the base plate 34 is set at 45-degree angle to the top plate 38 of the base 10, said top plate serving to support the bottom of casing 12 by means of bolts 14. If it desired to drive a nail straight down, then top plate 38 will be parallel to base plate 34.

A convenient L-shaped handle 40 is fixed to the top plate 38 normal to base plate 34 and serves to carry and properly position the tool. When not in use, the tool can be left free-standing with the casing front face 13 resting on the floor.

A magazine 42, of conventional construction, is removably carried alongside the web 44 of the base 10 just below the top plate 38. Magazine 42 carries a supply of nails N in a single row and which are pushed by a pressure plate spring loaded on a guiding rod 46 forming a handle 48 retained by a hook 50 fixed to the base 10. The magazine 42 is of conventional construction and serves to feed successive nails N against a guiding plate 52 removably fixed by bolts 54 to a cross-plate 56 permanently fixed across the front edge of web 44.

As shown in FIG. 1, the guide plate 52 and the cross-plate 56 extend at 45 degrees to and below the underface 36 of base plate 34, so as to engage the step at the root of the tongue T of the plank P. There is defined a guiding passage between the guide plate 53 and the cross-plate 56, in which slides a flat blade-like plunger 58 to effect a nailing stroke, that is to push against the head of the nail in position and drives the same to its final destination, as shown in FIG. 1. The plunger 58 is fixed to a piston 60 by means of a cross bolt 62. The piston 60 has a sliding fit within a cylinder 64. The latter is fixed within aligned holes 66 formed in the bottom 68 and in a top inward flange 70 of casing 12. The cylinder 64 forms a fluid-tight joint with the parts 68 and 70 by means of O-rings 72. The bottom end 74 of cylinder 64 is closed by a damper plug 76, preferably made of cushioning material, such as polyurethane, and provided with a slit 78 for slidably receiving the plunger 58, during its nailing stroke.

Figure 3:
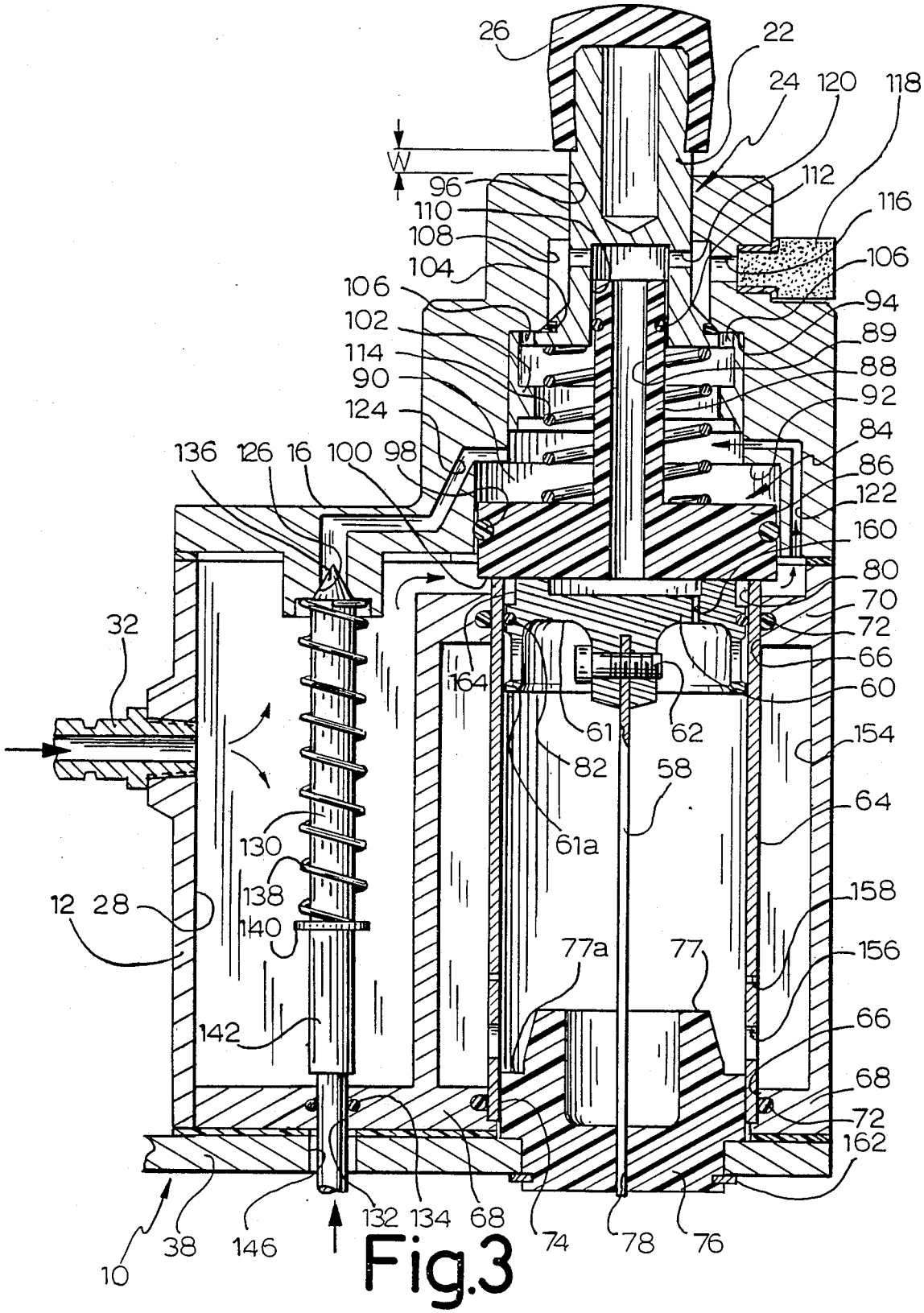
FIG. 3 is a vertical section taken along line 3—3 of FIG. 2.
Figures 4, 4A, 4B, 4C:
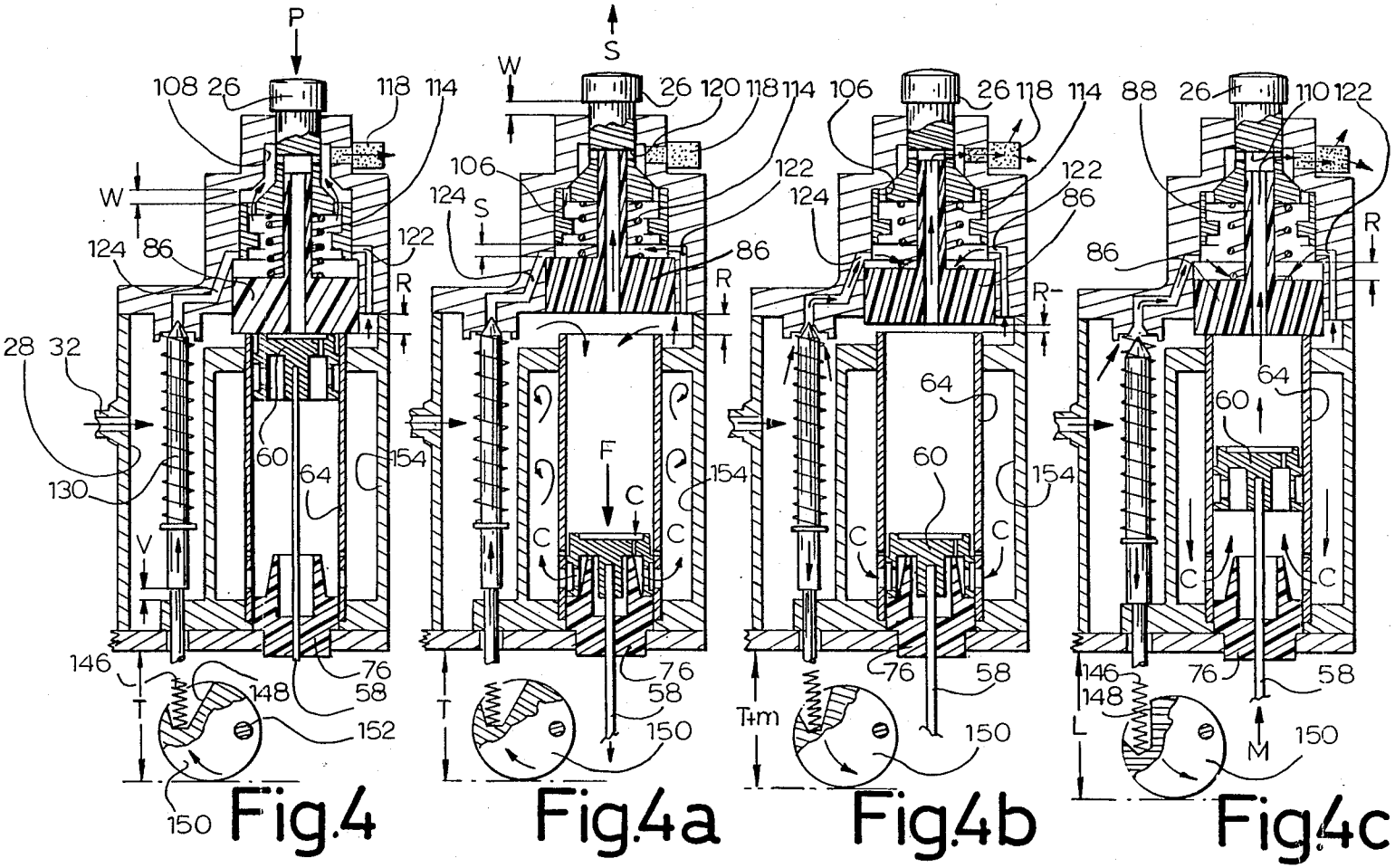
FIGS. 4, 4*a*, 4*b*, and 4*c* are views similar to that of FIG. 3, but showing different stages of the operation of the component parts.

At the start of the nailing stroke, the piston 60 is at the top end 80 of cylinder 64, as shown in FIG. 3, and at the end of the nailing stroke, the piston 60 engages the damper plug 76, as shown in FIGS. 4A and 4B. Piston 60 has an underface 61 surrounded by a skirt 61*a*. Damper plug 76 has an upstanding rib 77 surrounded by a lower annular step 77*a*. At the end of its nailing stroke piston make contact with damper plug 76 at two annular zones: rib 77 with underface 61 and skirt 61*a* with step 77*a*. The impact of piston 60 is efficiently dampened. This impact is greater when no nail is ejected.

The piston 60 has a sealing fit with a cylinder 64, being provided with an O-ring 82. The top end 80 of cylinder 64 is completely open and is in communication with the compressed air reservoir 28.

A closure member 84, in the form of a lower disc 86 with an upstanding stem 88, is mounted over the cylinder 64 within a chamber 90 made in the cover plate 16 and its extension 20.

Stem 88 has an axial through bore 89 opening at the underside of closure disc 86. Chamber 90 is composed of three sections of decreasing diameter in the upward direction, the lower section being separated from the intermediate section by a step 92 and the intermediate section being separated from the upper section by a step 94. The upper section communicates with an axial bore 96 in which is slidably mounted the head 22 of the trigger 24.

Disc 86 of closure 84 has a sliding fit with the lower section of chamber 90 being provided with O-ring 98. Disc 86 is designed to make an airtight fit with the top edge of cylinder 64 in the down-position of the closure 84. Closure 84 is movable to a top limit position in which the top face of disc 86 abuts against the step 92. In the closed position of the closure 84, the peripheral portion 100 of the underface of the disc 86 protrudes exteriorly of the cylinder 64, so as to be exposed to the air pressure within the reservoir 28. Trigger 24 defines a lower skirt 102 in sliding contact with the intermediate chamber section, the top end of the skirt 102 being provided with a seal 104 adapted to make sealing contact with the step 94 in the top limit position of the trigger 24. Immediately below seal 104, the top portion of the skirt 102 is provided with a plurality of through-bores 106 for establishing communication between the portion of chamber 90 above the closure disc 86, and the upper section of the chamber 90, this upper section being shown at 108 and surrounding the head 22 of the trigger 24. This head 22 has a central downwardly-opening bore 110 opening within the interior of skirt 102 and slidably receiving the upper end of the closure stem 88, the latter being provided with an O-ring 112 for airtight contact.

A compression coil spring 114 surrounds the stem 88 and bears against the top face of the closure disc 86 and against the underface of the head 22 of trigger 24. The coil spring is located within the skirt 102 of the trigger 24. This coil spring biases the trigger 24 in top limit position, with the top of the skirt abutting against the upper step 94. The spring also biases the closure 84 in down-limit position, with the disc 86 in sealing engagement with the top of cylinder 64. The upper chamber section 108 opens to the exterior of the body through a lateral bore 116 fitted at the exterior with a plug 118 of porous material, allowing air escape while serving as a silencer. The upper chamber section 108 is also in communication with the axial bore 106 of the trigger head 22 by means of lateral bores 120, made in said head 22. The communication between the stem through-bore 89 and trigger head lateral bores 120 is closed when stem 88 makes airtight contact with the bottom of head axial bore 110.

A first air feeding passage 122, made in the cover plate extension 20, opens within reservoir 28 at one end and within the portion of the chamber 90 just above the step 92. A second air-feeding passage 124 is also made in the cover plate 16 and its extension 20. This second air-feeding passage 124 has an inlet 126 opening directly within the reservoir 28 and an outlet 128 opening laterally within the chamber 90 and downwardly at step 92.

Outlet 128 of air-feeding passage 124 is always in communication with the chamber 90 over the closure disc 86 independently of the up-and-down position of the trigger 24 or of closure disc 86.

A needle valve 130 extends within the reservoir 28 and is guided for up-and-down airtight movement through a hole 132 provided with an O-ring 134 and made in casing bottom 68. The top pointed end 136 of the needle valve 130 serves to seal close the tapered inlet 126 of the second air-feeding passage 124 when the needle valve 130 is moved upwardly. The needle valve is normally maintained in open position by means of a compression coil spring 138 surrounding the needle valve and abutting at its upper end within a recess formed around the inlet 126, while the lower end of the coil spring abuts against the flange 140 of the needle valve 130.

The bottom end of enlargement 142 of the needle valve abuts against the casing bottom 68 to define the lower limit position of the needle valve. The needle valve extends through a bore 146 of the top plate 38 of the base 10 and its lower end is fitted with a spring member 146, which abuts against the bottom of a notch 148 made at the periphery of a feeler disc 150. This feeler disc 150 is eccentrically pivoted at 152 to the web 44 of base 10, and when the needle valve is in its open position, the feeler disc 150 partially extends below the underface 36 of the base plate 34, so as to contact the work-piece or plank P to be nailed. Thus, when the tool is properly positioned in contact with the plank P, the feeler disc 150 pivots, as shown by the arrow in FIG. 1, thereby lifting the needle valve 130 to its closed position.

Casing 12 has a portion completely surrounding the cylinder 64, so as to form an annular chamber 154, which is completely sealed except for its communication with the inside of the cylinder 64 by means of holes 156, 158 made in the wall of the cylinder adjacent the plug 76.

Piston 60 is provided with a through-bore 160 communicating opposite sides of the piston to make up for the air lost through slit 78. The casing 12 can be easily detached from the base 10 by removing bolts 14. Damper plug 76 remains attached to casing bottom 68 by a split ring 162 (see FIG. 3). Therefore, this damper plug 76 can be easily removed from the cylinder 64 to have access to bolt 62 so that the plunger 58 can be easily replaced when broken.

In accordance with the invention, the coil spring 114, which extends between the trigger 24 and the closure disc 86, must be calibrated in relation to the operating air pressure and also in relation to the surface area of the peripheral edge 100 of disc 86, that is the edge portion on the outside of cylinder 64 and exposed to the air pressure within reservoir 28.

The calibration should be such that, supposing the chamber 90 be at the air pressure of the reservoir, then the sum of the downward force exerted by the air pressure and of the downward force exerted by the spring 114 must be greater than the upward force exerted by the compressed air on the peripheral edge 100 in the closed position of the disc 86. Also, the downward force exerted by the spring 114 by itself must be less than the upward air pressure force exerted on peripheral edge 100.

The tool operates as follows: in the rest-position of the tool, the elements are in the position shown in FIG. 3. The piston 60 is held at the top of cylinder 64 by friction. The closure disc 86 and trigger 24 are maintained in down cylinder-closing position and in up-position, respectively by the compressed air in chamber 90 and by compression of coil spring 114. In this rest-position and supposing the feeler disc 150 is in released position, both air-feeding passages 122 and 124 are open, whereby the air pressure in the chamber 90 on top of the disc 86 is equal to the air pressure within the reservoir 128. In this connection, it is noted that the first air exhaust passage formed by the chamber upper section 108 and the lateral bore 116 is closed by the seal 104 of the trigger 24. Also in this position, it is noted that the second air exhaust passage defined by the axial bore 89 of stem 88 and lateral bores 120, 116 is open to ambient air, whereby the space in the cylinder on top of the piston 60 is at atmospheric pressure; it follows that the closure disc 86 is firmly closing the cylinder not only under the action of the compression spring 114 but also under the action of the downward force exerted by the compressed air in chamber 90.

When the tool is made to contact the plank P to be nailed, the needle valve 130 is raised, closing the second air-feeding passage 124. A substantial force is required to push down the trigger 24, for instance a 120-pound force is required such as achieved by a hammer blow. The trigger 24 moves down against the bias of compression spring 114, whereby the skirt 102 closes the first air-passage 122 and the first air exhaust passage becomes open, seal 104 moving away from the upper step 94 (FIG. 4). Therefore, the air pressure within the chamber 90 on top of closure disc 86 rapidly decreases to atmospheric pressure and the upward force exerted on peripheral edge 100 of the closure 84 by the compressed air within reservoir 28 raises the disc 86, as shown in FIG. 4a. Disc 86 is raised to its top limit position in which it abuts the step 92. Trigger 24 is simultaneously raised by disc 86 through spring 114. Piston 60 is fully exposed to the compressed air and accomplishes its nailing stroke in which the plunger 58 pushes against the head of a nail in position in the guide between plates 52 and 56. The nailing stroke is terminated when the piston reaches the down-position shown in FIG. 4A.

A certain delay occurs between the hammer blow and the start of the nailing stroke: this delay is caused by the time required for the evacuation of compressed air on top of closure disc 86. Thus the tool, under the force of the hammer blow, pushes against the plank P to position the same before nail N is driven.

During the nailing stroke, the air ahead of the piston 60 accumulates within the annular chamber 154 through the holes 156, 158 and the air compressed within the annular chamber will serve to return the piston to its initial upper position, as later described.

During the nailing stroke, it is noted that the second air exhaust passage 89 is closed to ambient air, because stem 88 of the closure 84 is in the up-position and its top is in sealing contact with the bottom of axial bore 110 of the trigger head 22.

Immediately after the hammer blow, the trigger moves back to its up-position under the action of the compression spring 114. Therefore, the first air-feeding passage 122 is again open while the first air exhaust passage 108, 116 becomes closed by the seal 104. Therefore, the chamber 90 on top of the closure disc 86 fills up with compressed air, and once the pressure is equal to that of the reservoir 28, the compression spring 114 pushes closure disc 86 to its down cylinder-closing position.

During the nailing stroke, there is an upward reaction exerted on the nailing tool, and this causes partial opening of the needle valve 130, as shown in FIG. 4B, whereby the compressed air from the reservoir 28 fills up the chamber 90 more quickly through not only the first air-feeding passage 122 but also through the second air-feeding passage 124.

Once the closure disc 86 is in fully closed position, as shown in FIG. 4C, with the trigger 24 fully up, the second exhaust passage is open to ambient air through the bore 89 of stem 88 and, therefore, the piston is allowed to effect is return stroke because the cylinder area above piston 60 is now under atmospheric pressure and the piston is pushed up by the air compressed in the annular chamber 154.

It is noted that holes 158 are calibration holes communicating chamber 154 with a top annular gap 164 of piston 60 when the latter has reached its down position (FIG. 4a). The pressure in chamber 154 is raised sufficiently to return piston 60.

The fact that a hammer blow is required to operate the trigger constitutes a first safety feature, whereby the nailing tool cannot be operated by the simple manual pulling of a trigger.

The fact that the needle valve 130 must be close din order that the tool may effect a nailing stroke, constitutes a second safety feature. If the needle valve is not closed, this means that the second air-feeding passage 124 maintains the chamber 90 at the air pressure of the reservoir, even if the trigger moves down under a hammer blow. Therefore, the closure disc 86 remains in closed position.

I claim:

1. A nailing tool comprising a body defining a reservoir adapted to be fed with compressed air, a cylinder fixed within said body and having a lower and an upper end, a plug closing the lower end of said cylinder and having a nailing plunger-receiving slit, a piston slidable in said cylinder, a nailing plunger fixed to said piston and extending through said slit, said piston reciprocable in said cylinder to cause said plunger to accomplish a nailing stroke, said cylinder fully open at its upper end, said body defining a chamber co-axial with and communicating with said cylinder upper end and with said reservoir, a cylinder closure having a leak-proof sliding fit with said chamber and reciprocable therein between a down-position resting on and closing said cylinder upper end, and an up-position opening said cylinder upper end; said closure having an underface which, when said closure is in down-position, protrudes outwardly from said cylinder and is exposed to the compressed air in said reservoir, a trigger located over said closure and movable between a top limit position and a down limit position in said chamber and having a head exposed externally of said body, a compression spring located between said trigger and said closure within said chamber, a first air-feeding passage communicating said reservoir and said chamber above said closure, said trigger closing and opening said first air passage in its down and top limit positions, respectively, a first air exhaust passage communicating said chamber above said closure with the ambient air, a second air exhaust passage extending through said closure and communicating the space of said cylinder above said piston with the ambient air, said trigger closing and opening said first air exhaust passage to ambient air in its top and down limit positions, respectively, with said second exhaust air passage being closed and open to ambient air in the up-and-down positions of said closure, respectively with said trigger being in top position, the sum of the downward forces exerted by said compression spring and by said compressed air onto said closure when closed being greater than the upward face exerted by said compressed air on said closure when closed, the downward force exerted by said compression spring on said closure when closed being smaller than the upward force exerted by said compressed air on said closure when closed, where in the rest-position of said tool, the air pressure in said chamber above said closure is equal to the air pressure in said reservoir, the air pressure in said cylinder above said piston is ambient air, said closure being kept closed not only by said compression spring but also by the force differential exerted by said air pressure over and under said closure, and a downward impact force exerted on said trigger causes downward movement of said trigger against the bias of said compression spring and exhaust of the compressed air in said chamber above said closure through said first exhaust means, whereby said closure moves to its up-position closing said second air exhaust passage and allowing compressed air from said reservoir to enter said cylinder and cause said piston to effect a nailing stroke.

2. A nailing tool as defined in claim 1, further including a second air-feeding passage communicating said reservoir and said chamber above said closure, normally-open valve means in said second air-feeding passage and a feeler means carried by said tool and connected to said valve means to close the same when said feeler means makes contact with and senses that the tool is properly positioned on a work-piece to be nailed, the air flow from said reservoir through said second air exhaust passage when open, preventing the air pressure in said chamber above said closure from dropping sufficiently to cause opening of said closure.

3. A nailing tool as defined in claim 2, wherein said body has a base face adapted to contact said work-piece and said valve means includes a needle valve member extending through said reservoir and having a pointed end entering an inlet of said second air-feeding passage, a spring urging said needle valve to open position, said feeler means including a disc eccentrically pivoted to said body adjacent said base face, a connection between said disc and said needle valve, said last-named spring biasing said disc to a position thereof with a portion thereof protruding from said base face, so that said needle valve closes said inlet upon said feeler disc contacting and being retracted by a work-piece.

4. A nailing tool as defined in claim 2, wherein said trigger includes a skirt in slidable sealing engagement with said chamber above said closure, said skirt having a greater diameter than the head of said trigger, said chamber having a restricted portion against which said skirt abuts in the top limit position of said trigger, said first air-feeding passage opening within said chamber above said closure at a position below said skirt when said trigger in its top limit position, and opposite said skirt when said trigger is in its lower limit position, whereby said skirt closes said first air-feeding passage in the latter position.

5. A nailing tool as defined in claim 4, wherein said closure has a central upwardly-extending stem, said stem having an upper end portion in leak-proof slidable engagement with a central bore of said trigger above said skirt, said second air exhaust passage extending through the centre of said closure, through said stem and through a lateral bore in the head of said trigger to communicate with the exterior of said body, relative movement between said trigger and said stem causing opening and closing of said second air exhaust passage at said lateral bore.

6. A nailing tool as defined in claim 1, further including an air storage chamber in communication with said cylinder adjacent said plug, the air in said cylinder ahead of said piston being transferred and compressed within said storage chamber during the nailing stroke of said piston and returning said piston at the end of said nailing stroke to an initial position adjacent said closure.

7. A nailing tool as defined in claim 6, further including a restricted bleeding passage within said piston establishing a communication between the two portions of said cylinder located on opposite sides of said piston, whereby compressed air pushing said piston during its nailing stroke is partly transferred through said bleeding passage ahead of said piston and into said storage chamber.

8. A nailing tool as defined in claim 6, wherein said storage chamber forms an annular chamber surrounding said cylinder within said body.

* * * * *